United States Patent [19]

Ulrich

[11] 4,148,151

[45] Apr. 10, 1979

[54] TOY FIGURINE

[75] Inventor: Hans R. Ulrich, Wuppertal, Fed. Rep. of Germany

[73] Assignee: Schleich & Co., Fed. Rep. of Germany

[21] Appl. No.: 801,611

[22] Filed: May 31, 1977

[30] Foreign Application Priority Data

Jun. 9, 1976 [DE] Fed. Rep. of Germany ..... 2625851

[51] Int. Cl.[2] ..... A63H 7/00

[52] U.S. Cl. ..... 46/126; 46/149

[58] Field of Search ..... 46/151, 156, 116, 115, 46/119, 149, 136, 126, 118, 161, 163, 22, 102, 105, 110

[56] References Cited

U.S. PATENT DOCUMENTS

| | | | |
|---|---|---|---|
| 1,003,807 | 9/1911 | Rutz | 46/126 |
| 1,364,881 | 1/1921 | Koch | 46/151 |
| 2,624,155 | 1/1953 | Boyce | 46/149 |
| 3,918,196 | 11/1975 | Schleich | 46/29 |

OTHER PUBLICATIONS

Snap-N-Play Building Blocks, Barry Toycraft Catalog, 1965.

*Primary Examiner*—Russell R. Kinsey
*Assistant Examiner*—Mickey Yu
*Attorney, Agent, or Firm*—Frailey & Ratner

[57] ABSTRACT

A toy figurine having movable leg limbs actuated by two actuating rods connected to each respective leg limbs. The rods having an aperture at one end and a finger receiving cavity at the other end. A cross-bar pivotably connecting the rods about the mid-section. A pair of fasteners each having a shaft and an upper and lower disc-shaped head portion, enlarged with respect to the shaft, at each distal end of the shaft. The rods are rotatably mounted on a respective shaft by each aperture. A pair of pins are provided on each of the upper head portions for mounting each fastener to a respective leg limb of the figurine.

10 Claims, 2 Drawing Figures

TOY FIGURINE

Figure 1:
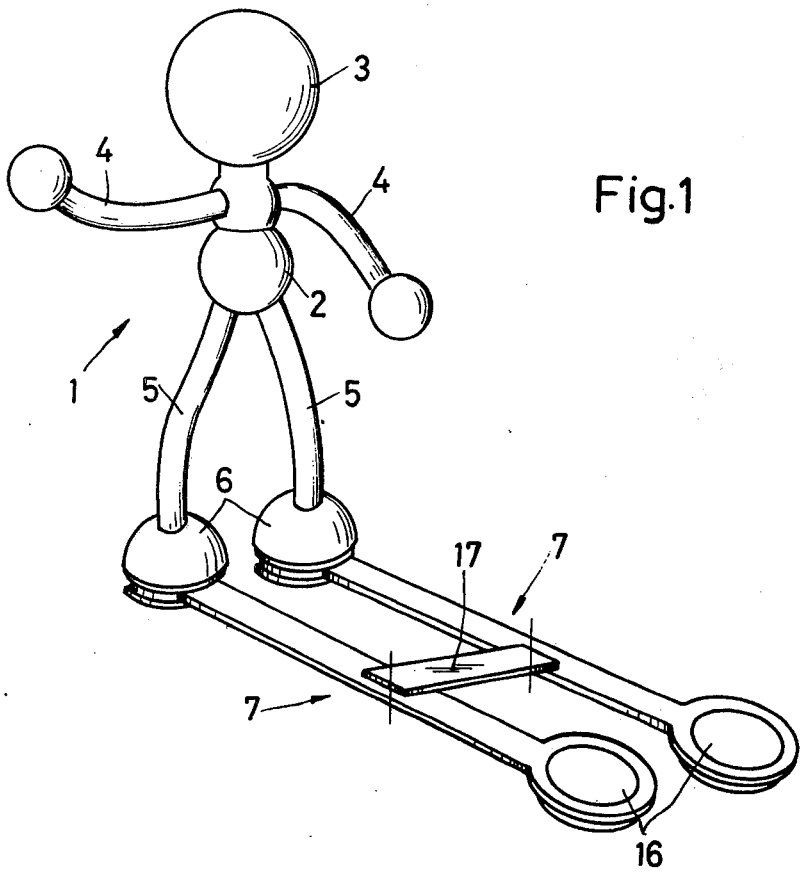

The invention relates to a toy figurine with movable limbs, more particularly a non-elastic flexible, human-like bendable figurine of plastics which is provided with a wire insert.

Such toy figurines, which are also suited for publicity purposes, have a rather distinctive toy characteristic when embodied as non-elastic, flexible bending figurines because the flexibility of the limbs makes it possible to display the figurines in a plurality of desired positions and postures. Each individual representation necessarily presupposes that the shape of the figurine is directly changed.

It is known, more particularly for dolls, to simulate walking motions by means of mechanisms incorporated in their body. The actual mechanical system of such walking mechanisms is rather complex and therefore correspondingly trouble-prone. To enable them to be accommodated in such dolls, these mechanisms call for bodies of large size so that even simple embodiments have hitherto hardly been used for smaller figurines. To simulate movement in such smaller figurines it is also known to arrange the leg limbs on the body so that placing the figurine on an inclined plane automatically initiates successive steps of motion, thus enabling a figurine of this kind to move automatically from the highest to the lowest place of the inclined plane. Walking aids of this kind suffer from a disadvantage in as much as they call for the provision of an inclined plane and any influence aimed at changing the movement routine is limited to changing the angle of inclination of said plane. Furthermore, such walking aids suffer from a disadvantage since they are unsuitable for bending figurines because their mechanical system presupposes that the leg limbs and the body are able to move relative to each other. The only means available hitherto to enable such bending figures to simulate a walking motion was to express a single step of motion in the manner of an instant photographic exposure by way of a corresponding position or posture adopted by the figurine and to prepare the next step of motion for a further instant exposure by changing the position or posture of the figurine.

It is the object of the invention to disclose suitable apparatus for simulating the walking motions in toy figurines of the kind described hereinbefore and for such apparatus to be made particularly suitable for relatively small bending figurines but also for use in like manner for other figurines which have more rigid limbs that are movably disposed on the body. A more generalized purpose is for such apparatus to be inexpensively produced and its basic design would have to be suitable for different figurine embodiments, the routine production of which would not, as far as possible, require any substantial modification for adaptation, or reception, or incorporation of such a device.

According to the invention, this problem is solved in that in a toy figurine of the kind described hereinbefore substantially rod-shaped walking aids are connected to each of the leg limbs by means of a pivoting shaft. Conveniently, the pivoting shafts should be detachably mounted on the leg limbs and in this embodiment they can comprise a stud which can be plugged or clamped on the foot part of the leg limbs and the associated rod-shaped walking aid is pivotably connected to said stud.

To simulate walking motions, for example for a human-like bending figure, the present invention proposes that the foot part of each of the two leg limbs is provided with a rod-like walking aid which is pivotably connected to the leg limbs. Accordingly, if the ends of the said rod-shaped walking aids are subjected to finger pressure which, if the affected figurine is placed on a supporting surface, is directed against the supporting surface as well as in the appropriate direction of the rod, it is possible to simulate motion of the figurine by both walking aids being alternately advanced in the appropriate rod direction. If, therefore, one walking aid is held and the other walking aid is advanced along the direction of its rod, the toy figurine will experience simultaneous pivoting about the two pivoting shafts by means of which the two walking aids are connected to the leg limbs. Such common pivoting results in the entire figurine being pivoted about a further pivoting axis extending parallel with the two pivoting shafts and through the body of the figurine, thus giving the appearance as though the body intended to follow the leg limb which had just been moved. If the common pivoting direction of the two leg limbs is then practically reversed by holding the previously moved walking aid and by advancing the previously held walking aid in the rod direction, the body of the figurine will also follow this reverse pivoting direction. This gives the appearance as though the figurine intended to assist the motion of the other leg limb. Alternate motion of the two rod-shaped walking aids thus simulates an exceptionally realistic walking motion which can be further varied by both walking aids being moved simultaneously or the distance of their travel being continually changed. In bending figures it is then also possible to obtain the additional effect of incorporating a further imaginative content into the relevant simulation of movement by changing the position or posture, i.e. by corresponding non-elastic bending, more particularly of the leg limbs.

Figure 2:
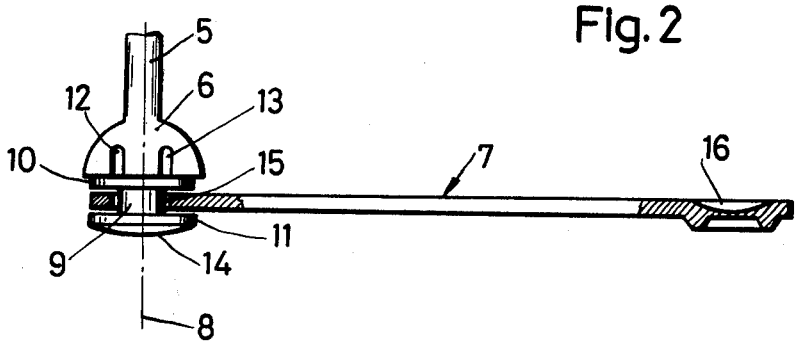

Advantageous embodiments of the invention are disclosed in the claims relating thereto. One embodiment of the invention will be explained hereinbelow by reference to the accompanying drawings, FIG. 1 of which shows a toy figurine according to the invention, embodied as a bending figurine in perspective view, and FIG. 2 shows a longitudinal section of a rod-shaped walking aid each of which is detachably attached to the two leg limbs of the illustrated bending figurine.

The bending figurine, referenced by the numeral 1 in its entirety, comprises a body 2, a head 3, two arm limbs 4 and two leg limbs 5, each of which has a foot part 6 formed thereon. On their underside the foot parts 6 are provided with a plane support surface which is sufficiently large to enable the figurine to stand freely if it is placed on a plane support surface by means of its foot part 6. The bending figurine 1 is provided in conventional manner with a wire insert, not shown, which is surrounded by a soft plastics material the elasticity of which is absorbed by the wire insert so as to retain any bending performed on the limbs 4 and 5. The position of the bending figurine 1 as illustrated in the drawing is therefore retained until a bending force is applied, for example on the left arm limb shown in raised form, so that the said arm limb can be brought into the same position relative to the body 2 as that of the right-hand arm limb.

Each of the two foot parts 6 of the leg limbs 5 is provided with a rod-shaped walking aid 7, the connection being effected through the appropriate pivoting axis 8. The said pivoting axis is embodied by a stud 9 which is disposed between two discs 10 and 11. The concentrically arranged discs 10 and 11 are of circular construction and have a diameter which is slightly smaller than the likewise circular support surface of the foot part 6 on which one disc 10 of the associated walking aid 7 bears by means of its surface. The disc 10 is provided with two insertion pins 12 and 13 which are driven into the associated foot part 6 to retain the relevant walking aid 7 so that the support surface which facilitates placing of the bending figurine 1 on a plane base is replaced by the underside 14 of the second disc 11. The support surface 14 which is operative in terms of the bending figurine is conveniently constructed in a slightly barrelled form so that there is only point contact with one affected support surface in the appropriate axis of rotation but the barrelling of the said support surface 14 must not be excessive as this would impair the free-standing characteristics of the bending figurine. As regards the arrangement of the stud 9, it should be noted that this extends on the relevant walking aid 7 through an opening 15, which is formed in a broadened end, and is larger than the diameter of the stud so that a pivotable connection with greater clearance is provided between the walking aid 7 and the associated stud 9 at this place. A broadened finger support surface 16, illustrated in the form of a member which is integral with the relevant walking aid, is also formed on the free end of the walking aids 7. According to one alternative embodiment, the finger support surface can be constructed in the same way as the walking aid ends which are connected to the foot parts of the leg limbs so that two discs, joined by means of a stud, are also connected to the above-mentioned rod ends, the stud providing an identical pivotable connection to the associated rod end.

For example, if finger pressure is applied with the index finger and middle finger of one hand to the finger support surfaces 16 of the two rod-shaped walking aids 7 and an attempt is made to advance the rods alternately, the bending figurine 1 will perform pivoting motions about the pivoting axes 8. These pivoting motions give the impression of a substantially natural walking motion, more particularly if the leg limbs 5 are bent so as to assist such simulation. Since the two walking aids 7 can be readily detached from the foot parts 6, the bending figurine 1 can be bent into the desired positions or postures even without such walking aids and it can also be seen that the walking aids on differently embodied bending figurines can be equally readily mounted without calling for any separate adaptation.

In addition the walking aids can also be adapted for mounting on the four leg limbs of animal-like bending figurines in which case it is merely necessary to provide each walking aid with a further pivotable facility for connection to one leg element and it is also feasible for the two walking aids to be additionally connected to each other by means of one or two cross-bars or joint strips 17 to obtain a kind of parallelogrammatic guide for the walking aids and thus to maintain a more accurate guidance for the motion.

Finally, it should be made clear that the walking aids according to the invention can of course also be convenient for toy figurines which have no leg limbs that are movable in relation to the body. Since such toy figurines, by contrast to non-elastic, flexible bending figurines, have only a rather insignificant playing purpose when the walking aids are removed and are thus scarcely on the market, they were not separately taken into account in the above description.

I claim:

1. A device for moving a toy figure having at least two leg limbs comprising two actuating rods pivoting means pivotally connecting each actuating rod to at least one respective leg limb, each pivoting means including a shaft secured to said leg limb and secured to a lower section of said shaft a disc-shaped head portion enlarged with respect to said shaft to provide a ground support for maintaining said toy figure in a substantially self supported upright position.

2. The device according to claim 1 in which each leg limb having a foot portion with a respective shaft being secured to the foot portion, each of said actuating rods being rotatably connected with a respective shaft between the respective foot portion and said disc-shaped head portion, the other end of each actuating rod being provided with an enlarged finger support surface.

3. The device according to claim 2 in which the toy figure comprises a flexible wire core enveloped by a synthetic resin keeping the limbs of the figure non-elastically flexible.

4. The device according to claim 2 in which each said shaft is provided at its both ends with an enlarged disc-shaped head portion of which the one head portion is provided with at least one pin adapted to be inserted removably into a hole of the respective foot portion of the leg limbs of the figure to be moved.

5. The device according to claim 2 in which the lower surface of the enlarged disc-shaped head portion is slightly curvilinear.

6. The device according to claim 2 in which the finger support surface is provided by the upper surface of a disc which is interconnected through a pin with a further disc, the pin being adapted to be rotatably connected to said other end of the respective actuating rod.

7. The device according to claim 4 in which the two enlarged disc-shaped head portions and the shaft are formed like the differently constructed button parts of a press button, the one button part comprising said shaft which is adapted to be passed through a hole provided in said one end portion of the respective actuating rod for being united with the other button part, and the other button part comprising said pin.

8. The device acording to claim 6 in which the two discs and the pin are formed like the differently constructed button parts of a press-button, the one button part comprising said pin which is adapted to be passed through a hole provided in said other end of the respective actuating rod for being united with the other button part, and the other button part comprising said finger support surface.

9. The device according to claim 1 in which the two actuating rods are each provided with two alike pivot axis adapted to be connected with the four leg limbs of an animal-like figure toy.

10. The device according to claim 1 in which the two actuating rods are pivotably interconnected by at least one cross-member or a flexible joint.

* * * * *